United States Patent [19]

Dobrusskin et al.

[11] 4,393,331

[45] Jul. 12, 1983

[54] HIGH PRESSURE MERCURY VAPOR DISCHARGE LAMP WITH OUTER BULB

[75] Inventors: Alexander Dobrusskin, Taufkirchen; Lutz Klein, Scheuring; Günter Woizan, Munich, all of Fed. Rep. of Germany

[73] Assignee: Patent-Treuhand-Gesellschaft für elektrische Glühlampen mbH, Munich, Fed. Rep. of Germany

[21] Appl. No.: 252,071

[22] Filed: Apr. 8, 1981

[30] Foreign Application Priority Data

Apr. 16, 1980 [DE] Fed. Rep. of Germany ... 8010444[U]

[51] Int. Cl.[3] ..... H01J 1/62; H01J 61/40

[52] U.S. Cl. ..... 313/489; 313/112

[58] Field of Search ..... 313/112, 486, 489

[56] References Cited

U.S. PATENT DOCUMENTS

| | | | |
|---|---|---|---|
| 2,966,605 | 12/1960 | Harris et al. | 313/112 X |
| 3,206,632 | 9/1965 | Rokosz | 313/112 X |
| 3,617,794 | 11/1971 | Bakel et al. | 313/112 |

*Primary Examiner*—Alfred E. Smith

*Attorney, Agent, or Firm*—Frishauf, Holtz, Goodman & Woodward

[57] ABSTRACT

High pressure mercury vapor discharge lamp having an outer bulb which is preferably spherical and which provides light having a color similar to that of an incandescent lamp. The inner surface of the outer bulb is provided with a red-emitting phosphor coating. The outer surface of the outer bulb is provided with a filter coating whose transmittance at 400 nm is about 40%, at 500 nm is about 60%, and at 600 nm is about 70%.

3 Claims, 4 Drawing Figures

HIGH PRESSURE MERCURY VAPOR DISCHARGE LAMP WITH OUTER BULB

The present invention provides a high pressure mercury vapor discharge lamp having an arc tube surrounded by an outer bulb which produces light having a color similar to that of an incandescent lamp.

It is known to apply coatings to the outer envelope which are filters for light, i.e. filter coatings. In one instance, an ellipsoidal outer bulb of a high pressure mercury vapor discharge lamp has a phosphor coating on its inner surface which emits yellow light and light of shorter wavelengths. A filter coating which transmits the yellow light and absorbs the light of the shorter wavelengths is applied to the outside of said outer bulb. This lamp is intended for use in street lighting instead of sodium vapor lamps at locations where there may be some danger to traffic, see British Patent Specification No. 818,423. Another high pressure mercury vapor discharge lamp intended for use to stimulate plant growth has two coatings applied to the inner surface of the outer bulb. The coatings comprise a filter coating consisting of cobalt aluminate. The cobalt aluminate filter coating is positioned between the inner glass wall of the outer bulb and the phosphor coating, see Japanese Patent Publication No. 43-3864.

It is an object of the present invention to provide a high pressure mercury vapor discharge lamp which has improved color rendering characteristics and which may be used for decorative outdoor and indoor lighting.

THE INVENTION

The present invention provides a high pressure mercury vapor discharge lamp having an arc tube which is surrounded by an outer bulb. The inner surface of the outer bulb is coated with a phosphor coating. The outer surface of the outer bulb is coated with a filter coating. The phosphor coating is a red-emitting phosphor. The filter coating is a coating whose transmittance at 400 nm is about 40%, at 500 nm about 60%, and at 600 nm about 70%.

The red emitting phosphor coating intended for use in combination with the filter coating of the present invention is preferably a europium-activated yttrium vanadate phosphate.

The filter coating preferably consists of a luster, i.e. a lustrous or gilded material preferably having a gold brown color when the lamp is not in operation. This latter feature is an advantage in that it provides a decorative appearance for the lamp even when it is not in operation which decorative appearance or effect is enhanced by the spherical shape of the outer bulb. The spherical shape of the outer bulb has the further advantage that there is a higher resistance to temperature changes because the temperature of the outer bulb is reduced because of the greater volume of the spherical shape which the outer bulb has.

DRAWINGS

DETAILED DESCRIPTION OF THE INVENTION

Figure 1:
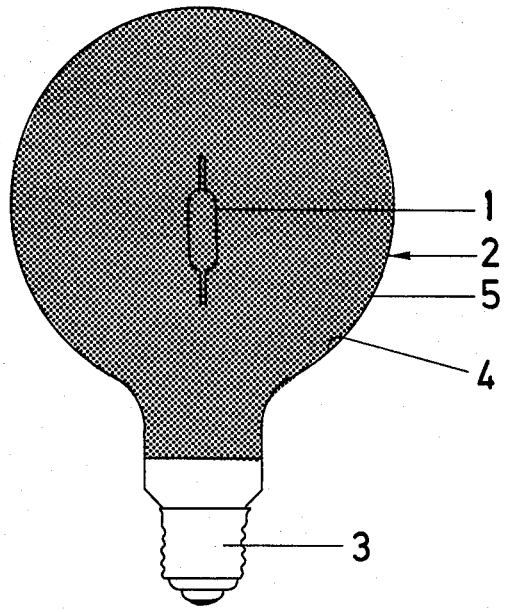
FIG. 1 is a sectional view of the high pressure mercury vapor discharge lamp.
Figure 2:
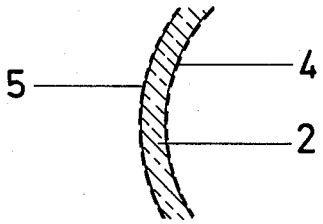
FIG. 2 is a cross-section of a detail of the coated outer bulb wall of the lamp.
Figure 3:
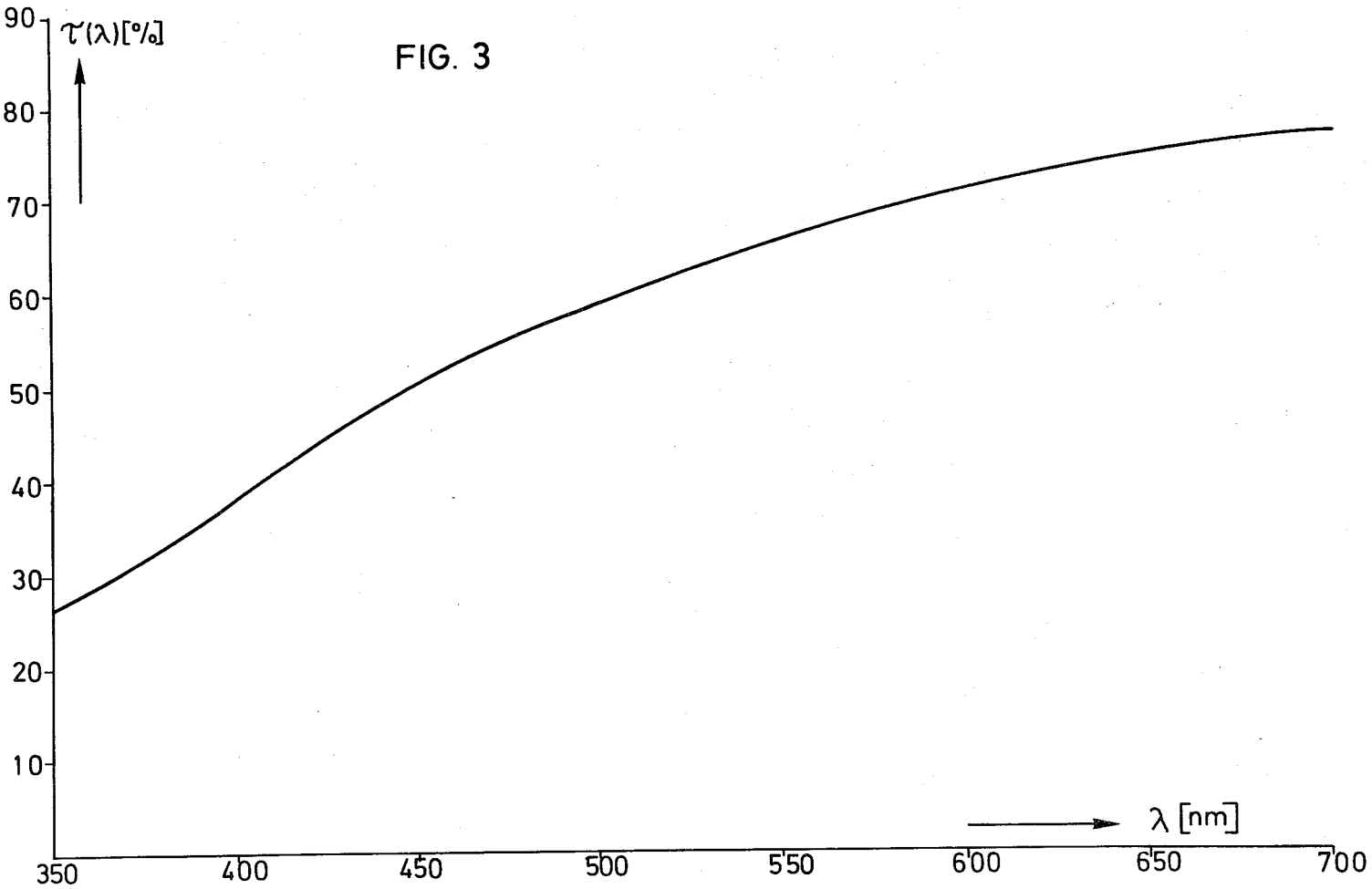
FIG. 3 is a graph depicting the transmittance $\tau$ ($\lambda$) of the filter coating in % as a function of the wavelength $\lambda$ in nanometers.
Figure 4:
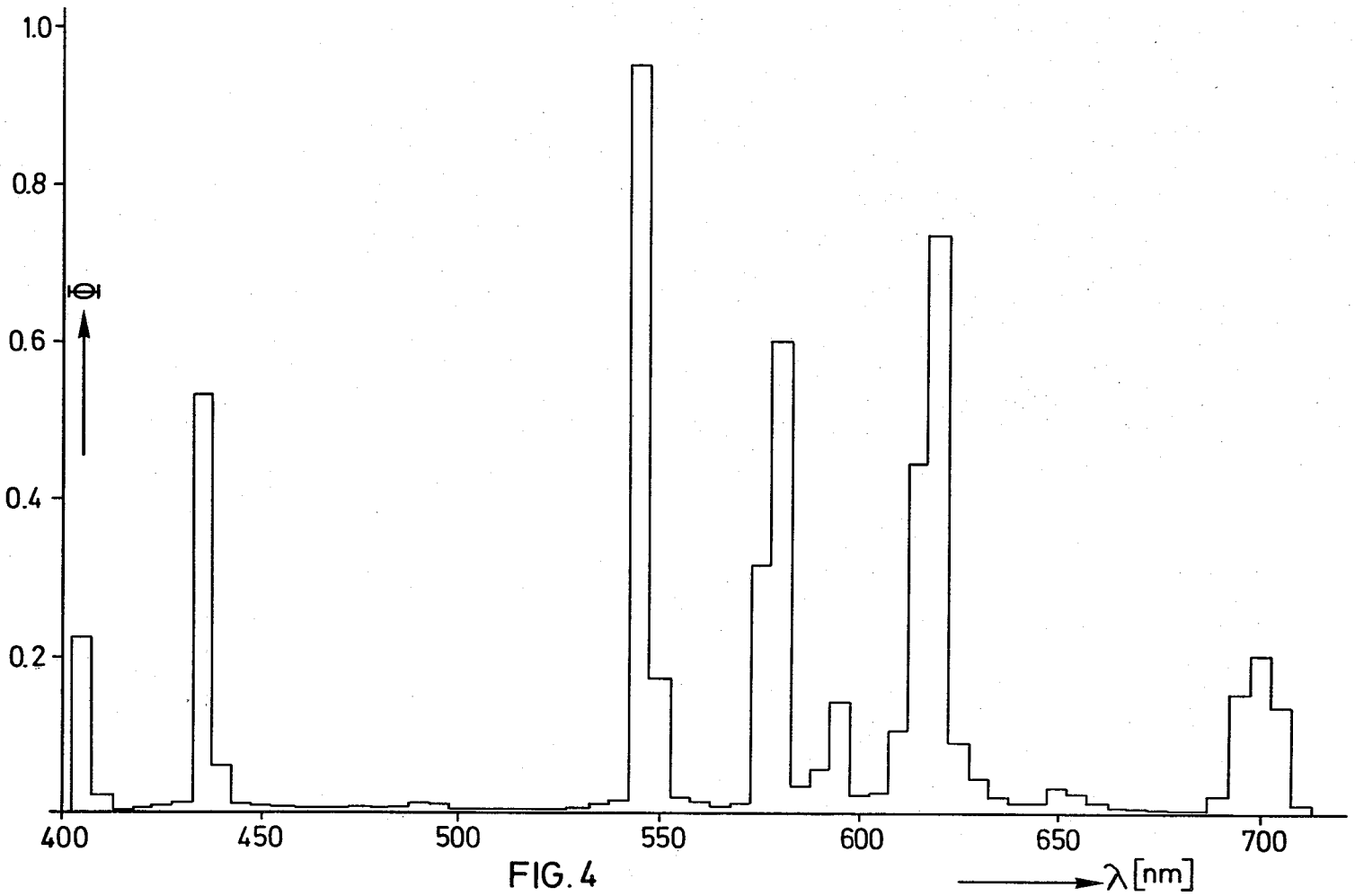
FIG. 4 depicts the spectral radiant flux $\Phi$ in watts per 5 nm.

In FIG. 1, the arc tube 1 of quartz glass is surrounded by an outer bulb 2 of soft glass which is provided with a screw base 3. The diameter of the outer bulb is 126 mm. The inner surface of the outer bulb 2 is covered (coated) with a phosphor of europium activated yttrium vanadate phosphate 4. The outer surface of the outer bulb 2 is coated with a luster color (filter coating) 5. The luster color 5 has the transmittance characteristics depicted in FIG. 3 of about 40% at 400 nm, about 60% at 500 nm and about 70% at 600 nm. FIG. 4 depicts the spectral radiant flux $\Phi$ of a 50 W lamp in accordance with the innovation. This spectral distribution yields the above color temperature and color rendering data.

The spherical discharge lamps of the present invention have low luminance, no glare, and a long life because of the large bulb diameter. They have the advantage of providing high pressure discharge lamps which are decorative clear glass lamps. The specific phosphor type, the thickness of the phosphor coating, and the filter coating are matched such that the high blue and green portions of the high pressure mercury vapor lamp are reduced without, however, reducing the red luminescent radiation of the phosphor. Because of the combination of the red-emitting phosphor with a filter coating having the specified transmittance characterstics, the discharge lamp provides light having a color similar to that of an incandescent lamp, i.e. a color temperature of approximately 2800 K, and a color rendering index $R_a$ 60. This is different than the usual high pressure mercury vapor discharge lamps having europium activated yttrium vanadate phosphate or similar phosphors coated thereon which have a color temperature of 3500 K or higher, and a color rendering index of at most $R_a$ 46.

The lamps of the present invention are particularly suited for outdoor lighting, for example, for lighting pedestrian areas, promenades, for park and garden illumination as well as for illuminating luminous structural elements. They are also suitable for the indoor lighting of foyers, halls, and are suitable for various decorative applications in which they provide long periods of service.

In a preferred embodiment of the lamp, the europium-activated yttrium vanadate phosphate is applied in a thickness of 2.5 mg/cm$^2$ over the inner surface of the outer bulb which has a diameter of 126 mm. The lustrous filter-coating having the characteristics specified for the present lamp is applied over the outer surface of said outer bulb. The thickness of said filter coating is $<0.1$ microns. Said filter coating consists of a commercially available luster (which may be obtained, for instance, from Heraeus, Germany, under the designation "Lüsterfarbe Orange N 475 A"). In accordance with Römpps Chemie Lexikon, lusters are enamel-type pigments by which iridescent, shining coatings are produced upon burning on glass, earthenware, porcelain and the like. After the burning, the luster constitutes on the glazing or on the glass an extremely thin film of oxides (coating thickness $<0.1$ $\mu$m). The said thin coating and the diversity of the optical refractive indexes of the luster colors and of the glazing or of the glass are the causes for the luster which is characterized by color, iridescent effect and sheen.

The europium-activated yttrium vanadate phosphate phosphor is of the type customarily used in high pressure mercury vapor discharge lamps.

Various changes and modifications may be made within the scope of the inventive concept.

We claim:

1. An improved high pressure mercury vapor discharge lamp comprising an inner arc tube which radiates light with electric leads attached thereto surrounded by an outer transparent bulb, the inner surface of said outer bulb being coated with a phosphor coating and the outer surface of said outer bulb being coated with a luster filter coating, the improvement comprising said phosphor coating on said inner surface being a red-emitting phosphor coating and the luster filter coating on said outer surface being an orange luster whose transmittance at 400 nm is about 40%, at 500 nm is about 60%, and at 600 nm is about 70%, whereby said lamp radiates light having a color similar to that of an incandescent lamp with a color temperature of about 2,800° K.

2. The lamp of claim 1 wherein the red-emitting phosphor coating comprises europium activated yttrium vanadate phosphate.

3. The lamp of any of claims 1 or 2 wherein said outer bulb is of spherical shape.

* * * * *